US006117603A

United States Patent [19]

Yu et al.

[11] Patent Number: 6,117,603

[45] Date of Patent: Sep. 12, 2000

[54] ELECTROSTATOGRAPHIC IMAGING MEMBER HAVING AN IMPROVED IMAGING LAYER

[75] Inventors: Robert C. U. Yu, Webster; Richard L. Post, Penfield; Satchidanand Mishra, Webster; Donald C. VonHoene, Fairport; Anthony M. Horgan, Pittsford; Bing R. Hsieh; Edward F. Grabowski, both of Webster; Kathleen M. Carmichael, Williamson; Huoy-Jen Yuh, Pittsford; John S. Chambers, Rochester, all of N.Y.

[73] Assignee: Xerox Corporation, Stamford, Conn.

[21] Appl. No.: 09/362,531

[22] Filed: Jul. 28, 1999

[51] Int. Cl.[7] ..... G03G 15/02

[52] U.S. Cl. ..... 430/66; 430/58.2

[58] Field of Search ..... 430/66, 58.2

[56] References Cited

U.S. PATENT DOCUMENTS

| | | | |
|---|---|---|---|
| 5,021,309 | 6/1991 | Yu | 430/58 |
| 5,069,993 | 12/1991 | Robinette et al. | 430/58 |
| 5,725,983 | 3/1998 | Yu | 430/58 |
| 5,919,590 | 7/1999 | Yu et al. | 430/58 |

*Primary Examiner*—Mark Chapman

[57] ABSTRACT

An electrostatographic imaging member including a supporting substrate having an electrically conductive outer surface and at least one layer having an exposed imaging surface, the layer including a continuous matrix comprising a film forming polymer and a surface energy lowering liquid polysiloxane represented by the formula:

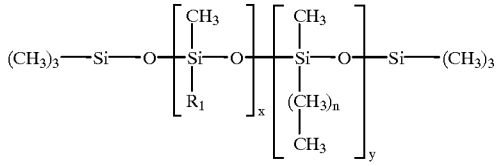

wherein x and y are independently selected integers between about 5 and about 500, n is a number between 0 and 10, and $R_1$ is selected from the group consisting of:

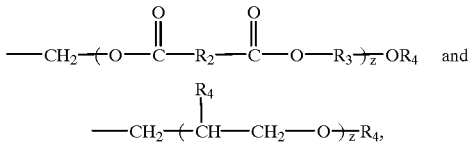

wherein z is number between about 1 and about 30, $R_2$ and $R_3$ are independently selected from alkylene groups containing from 1 to 10 carbon atoms, and $R_4$ is a hydrogen atom or an alkyl group containing 1 to 3 carbon atoms.

13 Claims, No Drawings

ELECTROSTATOGRAPHIC IMAGING MEMBER HAVING AN IMPROVED IMAGING LAYER

BACKGROUND OF THE INVENTION

This invention relates in general to electrostatography and, more specifically, to an electrostatographic imaging member having a functionally improved imaging layer.

Electrostatographic imaging members are well known in the art. Typical electrostatographic imaging members include, for example, photoreceptors for electrophotographic imaging systems and electroreceptors such as ionographic imaging members for electrographic imaging systems. Generally, these imaging members comprise at least a supporting substrate and at least one imaging layer comprising thermoplastic polymeric matrix material. The "imaging layer" as employed herein is defined as the dielectric imaging layer of an electroreceptor or the photoconductive imaging layer of a photoreceptor. In a photoreceptor, the photoconductive imaging layer may comprise only a single photoconductive layer or a plurality of layers such as a combination of a charge generating layer and a charge transport layer.

Electrostatographic imaging members have two distinctive configurations. They am are either in flexible belt form utilizing a flexible supporting substrate layer or rigid drum structure in which all the applied coating layers are applied over a rigid cylindrical supporting substrate.

Although the discussions hereinafter will focus on electrophotographic imaging members, the problems encountered therewith are equally applicable to electrographic imaging members. And for simplicity reason, only flexible electrophotographic imaging member belts will be discussed in detail.

In the art of electrophotography, an electrophotographic imaging member device comprising at least one photoconductive insulating layer is imaged by first uniformly depositing an electrostatic charge on the imaging surface of the electrophotographic imaging member and then exposing the imaging member to a pattern of activating electromagnetic radiation such as light which selectively dissipates the charge in the illuminated areas of the imaging member while leaving behind an electrostatic latent image in the non-illuminated areas. This electrostatic latent image may then be developed to form a visible image by depositing finely divided electroscopic marking particles on the imaging surface.

A photoconductive layer for use in flexible electrophotographic imaging member may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. Generally, the two electrically operative layers are positioned on an electrically conductive layer with the photoconductive layer sandwiched between a contiguous charge transport layer and the conductive layer. During an electrophotographic imaging process, the outer surface of the charge transport layer is normally charged in the dark with a uniform negative electrostatic charge and the conductive layer is utilized as a positive electrode. The photoconductive layer is capable of photogenerating holes and injecting the photogenerated holes into the contiguous charge transport layer. The charge transport layer in this embodiment must be capable of supporting the injection of photogenerated holes from the photoconductive layer and transporting the holes through the charge transport layer. In flexible electrophotographic imaging members, the electrode is normally a thin conductive coating supported on a thermoplastic resin web. Obviously, the conductive layer may also function as a negative electrode when the charge transport layer is sandwiched between the conductive layer and a photoconductive layer which is capable of photogenerating electron/hole pairs and injecting the photogenerated holes into the charge transport layer when the imaging member surface is uniformly charged with a positive charge while the conductive layer beneath serves as a negative electrode to receive the injecting holes. The charge transport layer in this embodiment, again, is capable of supporting the injection of photogenerated holes from the photoconductive layer and transporting the holes through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirely. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, during electrophotographic imaging member fabrication, it has been found that the resulting imaging member tends to curl toward the applied imaging layer side. Curling is undesirable because different segments of the imaging surface of the imaging member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. To eliminate the imaging member curling problem, a coating solution may be applied to the side of the supporting substrate opposite the photoconductive layer to form an anti-curl layer, so that the layer contraction after drying will counteract the tendency to curl and thereby provides the desired imaging member flatness.

In a typical 6,000 feet long roll of flexible electrophotographic imaging member production webstock, the charge transport layer comes to intimate contact with the anti-curl coating. The high surface contact friction generated between the charge transport layer and the anti-curl coating have been found to cause the formation of dimples, creases, and localized delamination of internal imaging member layers. Moreover, areas of polymer deformation developed in the layers of the imaging member, again due to the high surface contact friction of charge transport layer against the anti-curl layer in the webstock roll, have also been implicated in water mark like copy printout defects as the imaging member webstock is converted into belts and cycled in electrophotographic imaging machines. Since the charge transport layer is an exposed outermost layer, it has further been found that during cycling of the electrophotographic imaging member belts in electrophotographic imaging systems, the relatively rapid wearing away of the charge transport layer, due to mechanical interactions with toners, carrier particles, and toner image receiving papers, as well as against the sliding motion of cleaning devices, also results in significant change in the charged field potential under a normal photoelectrical imaging function condition to adversely affect copy print out quality. In some cases, the charge transport layer is worn away by as much 10 micrometers after about 20 thousand cycles. Since a typical charge transport layer, using film forming polycarbonate such as Makrolon (available from Bayer AG) and dissolved within an aromatic charge transport organic compound, has a surface energy of approximately 43 dynes/cm, the charge transport layer has the tendency to collect toner residues, dirt particles, and debris onto its outer surface and fuse them into comets on the charge transport layer surface to degrade imaging quality print-out on copies. Moreover, the high charge transport layer surface energy has only been found to impede toner image transfer to receiving papers it does also affect the cleaning device's cleaning efficiency.

Attempts have been made to overcome the above problems. However, the solution of one problem often leads to the creation of additional problems. For example, although the dispersion of micro-crystalline silica, from 3 to 5 weight percent level in the charge transport layer, has been found to decrease charge transport layer/anti-curl layer surface contact friction and enhance wear resistance of the charge transport layer, but excessive welding horn wear is observed when this electrophotographic imaging member belt is fabricated by the use of ultrasonically welding process of overlapping ends of an imaging member sheet. This wear is the result of the horn contacting with the melted charge transport layer, anti-curl coating, and all other imaging member coating materials when this molten mass is ejected to form splashing on either side of the overlapped ends.

It has also been observed that when conventional drum photoreceptors, using a blend of polycarbonate and small molecules charge transport organic compound charge transport layer, are extensively cycled in precision electrophotographic imaging machines employed an elastomeric polyurethane cleaning blade, an audible squeaky sound is generated due to the high contact friction interaction between the cleaning blade and the charge transport layer. Moreover, undesirable defects in copy print-out are also found to appear on receiving papers as a result of localized residue toner particles fusing onto the charge transport layer surface of the photoreceptor belt to form comet like spots.

INFORMATION DISCLOSURE STATEMENT

U.S. Pat. No. 5,069,993 issued to Robinette et al on Dec. 3, 1991—An exposed layer in an electrophotographic imaging member is provided with increase resistance to stress cracking and reduced coefficient of surface friction, without adverse effects on optical clarity and electrical performance. The layer contains a 2.5 weight percent solid polymethylsiloxane/polycarbonate diblock copolymer and an inactive film forming resin binder.

U.S. Pat. No. 5,725,983 issued to Yu et al. on Mar. 10, 1998—An electrophotographic imaging member is disclosed including

- a supporting substrate having an electrically conductive layer,
- a hole blocking layer, an optional adhesive layer, a charge generating layer,
- a charge transport layer, an anti-curl back coating, a ground strip layer and
- an optional overcoating layer, at least one of the charge transport layer, anti-curl back coating, ground strip layer and the overcoating layer comprising a blend of inorganic and organic particles homogeneously distributed in a film forming matrix in a weight ratio of between about 3:7 and about 7:3, the inorganic particles and organic particles having a particle diameter less than about 4.5 micrometers. These electrophotographic imaging members may have a flexible belt form or rigid drum configuration. These imaging members may be utilized in an electrophotographic imaging process.

U.S. Pat. No. 5,919,590 issued to Yu et al. on Jul. 6, 1999—An electrostatographic imaging member is disclosed comprising a supporting substrate having an electrically conductive layer, at least one imaging layer, an anti-curl layer, an optional ground strip layer and an optional overcoating layer, the anti-curl layer including a film forming polycarbonate binder, an optional adhesion promoter, a siloxane represented by the formula:

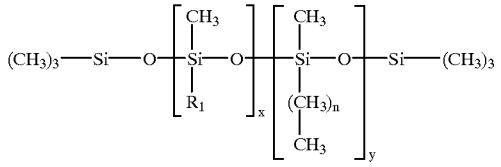

wherein x and y are independently selected integers between about 5 and about 500, n is a number between 0 and 10,

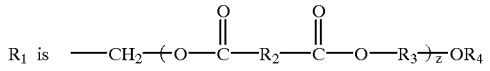

wherein z is number between about 1 and about 30, R.sub.2 and R.sub.3 are independently selected from alkylene groups containing from 1 to 10 carbon atoms, R.sub.4 is a hydrogen atom or an alkyl group containing 1 to 3 carbon atoms, and optional dispersed particles selected from the group consisting of inorganic particles, organic particles, and mixtures thereof.

U.S. Pat. No. 5,021,309 issued to Yu on Jun. 4, 1991—In an electrophotographic imaging device, material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

Thus, the characteristics of electrostatographic imaging members comprising a supporting substrate, having a conductive surface on one side, coated over with at least one photoconductive layer and coated on the other side of the supporting substrate with an anti-curl layer exhibit deficiencies which are undesirable in automatic, cyclic electrostatographic copiers, duplicators, and printers.

SUMMARY OF THE INVENTION

It is an object of the invention to provide an electrostatographic imaging member which overcomes the above-noted disadvantages.

It is still another object of this invention to provide an electrostatographic imaging member which has an improved wear resistant charge transport layer.

It is yet another object of this invention to provide a flexible electrostatographic imaging member having a charge transport layer which has lower surface contact friction against the anti-curl layer when the imaging member is in a roll of production webstock.

It is a further object of this invention to provide an electrostatographic imaging member with an improved charge transport layer having a low surface energy.

It is still a further object of this invention to provide an electrostatographic imaging member with a low surface energy charge transport layer or an optional overcoat layer which prevents dirt particle, toner residue, debris, and paper fiber accumulation onto the exposed surface of the layer.

It is also another object of the present invention to provide improved layered electrostatographic imaging members exhibiting enhanced toner image transfer efficiency.

It is still a further object of the present invention to provide an improved layered flexible electrostatographic imaging web having a charge transport layer which does not cause ultrasonic horn wear during the process of ultrasonic welding of seams to form belts.

It is also another object of the present invention to provide an improved layered electrostatographic imaging member belt or drum configuration which produces high quality images without copy printout defects associated with the comet like formations on the imaging member surface.

It is still yet another object of the present invention to provide a layered electrostatographic imaging member with an improved surface that promotes ease of cleaning blade sliding action and eliminates audible squeaky sounds during machine operation.

These and other objects of the present invention are accomplished by providing an electrostatographic imaging member comprising a supporting substrate having an electrically conductive outer surface and at least one layer having an exposed imaging surface, the layer comprising a continuous matrix comprising a film forming polymer and a liquid polysiloxane surface energy modifier represented by the formula:

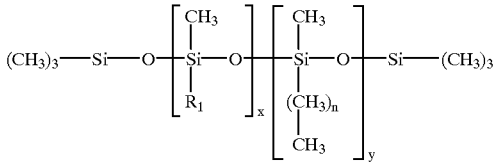

wherein x and y are independently selected integers between about 5 and about 500, n is a number between 0 and 10, $R_1$ is selected from the group consisting of:

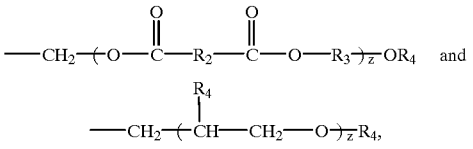

wherein z is number between about 1 and about 30, $R_2$ and $R_3$ are independently selected from alkylene groups containing from 1 to 10 carbon atoms, and $R_4$ is a hydrogen atom or an alkyl group containing 1 to 3 carbon atoms, and In a flexible web configuration, the electrostatographic imaging member is initially in the shape of a long web and is eventually formed into the shape of a seamed flexible belt which may be utilized in an electrographic or electrophotographic imaging process.

Although the present invention is deemed to encompass both electroreceptor and electrophotographic imaging members in either flexible configuration or rigid drum design, for the purpose of simplification and illustration only, the discussion hereinafter will focus primarily on flexible electrophotographic imaging member belts.

Electrophotographic imaging members are well known in the art. Electrophotographic imaging members may be prepared by any suitable technique. Typically, a flexible substrate is provided with an electrically conductive surface. At least one photoconductive layer is applied to the electrically conductive surface. Thus, as well known in the art of electrophotography, a single photoconductive imaging layer comprising photoconductive particles dispersed in an electrically active matrix may be applied or a plurality of photoconductive layers, such as a charge generating layer and a separate charge transport layer may be applied to the electrically conductive surface. Thus, as employed herein, the expression "at least one photoconductive imaging layer" encompasses both a single photoconductive imaging layer and a plurality of photoconductive layers, such as the combination of a charge generating layer and a separate charge transport layer. A charge blocking layer may optionally be applied to the electrically conductive surface prior to the application of the at least one photoconductive layer. If desired, an adhesive layer may be utilized between the charge blocking layer and the photoconductive layer. Usually, for a negative charge imaging member, a charge generation layer is applied onto the blocking layer and a charge transport layer is subsequently formed over the charge generation layer. This structure may also have the charge generation layer on top of the charge transport layer to form a positive charge imaging member.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials here may be employed various resins known for this purpose including polyesters, polycarbonates, polyamides, polyimides, polyurethanes, polysulfones, and the like which are flexible as thin webs. An electrically conducting substrate may be any metal, for example, aluminum, nickel, steel, copper, and the like or a polymeric material, as described above, filled with an electrically conducting substance, such as carbon, metallic powder, conductive metal oxides, and the like or an organic electrically conducting material. The electrically insulating or conductive substrate may be in the form of an endless flexible belt, a web, a sheet, and the like.

In a typical electrophotographic imaging member, the thickness selected for the substrate layer depends on numerous factors, including mechanical strength and economical considerations, and thus, this layer for a flexible belt may, for example, have a thickness of at least about 50 micrometers, or of a maximum thickness of about 150 micrometers, provided there are no adverse effects on the final electrophotographic imaging device.

In embodiments where the supporting substrate layer is not conductive, the surface thereof may be rendered electrically conductive by utilizing an electrically conductive coating layer. The conductive layer may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of a substrate having an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise nitrogen containing silanes or nitrogen containing titanium compounds as disclosed, for example, in U.S. Pat. No. 4,291,110, U.S. Pat. No. 4,338,387, U.S. Pat. No. 4,286,033 and U.S. Pat. No. 4,291,110, the disclosures of these patents being incorporated herein in their entirety. The blocking layer may be applied by any suitable technique such as spraying, dip coating, draw bar coating, gravure coating, silk screening, air knife coating, reverse roll coating, vacuum deposition, chemical treatment and the like. The blocking layer should be continuous and preferably has a thickness of less than about 0.2 micrometer.

An optional adhesive layer may be applied to the hole blocking layer. Any suitable adhesive layer may be utilized. One well known adhesive layer comprises a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000 and a Tg of about 32° C. If desired, the adhesive layer may comprise a copolyester resin. The adhesive layer comprising the polyester resin is applied to the blocking layer. Any adhesive layer employed should be continuous and, preferably, have a dry thickness between about 200 angstroms and about 3,000 angstroms and, more preferably, between about 400 angstroms and about 900 angstroms. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Any suitable photogenerating layer may be applied to the blocking layer or adhesive layer, if one is employed, which can thereafter be overcoated with a contiguous hole transport layer. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable inactive film forming resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the film forming binder generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and therefore apply the photogenerating layer coating mixture. Typical application techniques include spraying, dip coating, roll coating, wire wound rod coating, vacuum sublimation and the like. Removal of the solvent of a solvent coated layer may be effected by any suitable conventional technique such as oven drying, infrared radiation drying, air drying and the like.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to an activating wavelength of light. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of activating illumination.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound as the activating compound. An especially preferred charge transport layer employed in one of the two electrically operative layers in the multilayer-layer photoconductor of this invention comprises from about 35 percent to about 45 percent by ii weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl)phenylmethane; 4'-4"-bis(diethylamino)-2', 2"-dimethyltriphenylmethane, N,N -bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, 1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like. Molecular weights can vary, for example, from about 20,000 to about 1,500,000. An especially preferred film forming polymer for charge transport layer is polycarbonates. Typical film forming polymer polycarbonates include, for example, bisphenol polycarbonate, poly(4,4'-isopropylidene diphenyl carbonate), 4,4'-cyclohexylidene diphenyl polycarbonate, bisphenol A type polycarbonate of 4,4'-isopropylidene (commercially available form Bayer AG as Makrolon) represented by the formulae:

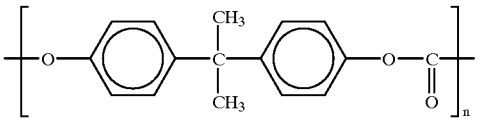

where n is the degree of polymerization;

poly(4,4'-diphenyl-1,1'-cyclohexane carbonate) represented by the formula:

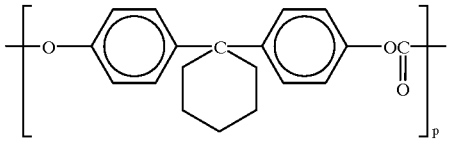

wherein p is the degree of polymerization, and the like. The polycarbonate resins typically employed for charge transport layer applications have a weight average molecular weight from about 70,000 to about 150,000 for robust mechanical performance.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the entire disclosures thereof being incorporated herein by reference.

Any suitable and conventional technique may be utilized to mix and thereafter apply the charge transport layer coating mixture to the charge generating layer. Typical application techniques include spraying, die casting, dip coating, roll coating, wire wound rod coating, and the like. Drying of the deposited coating may be effected by any suitable conventional technique such as oven drying, infra red radiation drying, air drying and the like. Generally, the thickness of the charge transport layer is between about 5 micrometers and about 100 micrometers, but thicknesses outside this range can also be used provided that there are no adverse effects.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2.1 to 200:1 and in some instances as great as 400:1.

Alternatively, instead of a small molecule transport material dissolved or molecularly dispersed in an inactive film forming polymer, the charge transport layer may comprise a charge transporting polymer which performs both the binder and charge transporting functions. If desired a charge transporting small molecule may be blended with the charge transporting polymer. Charge transporting polymers are well known in the art. These include active transporting polymers containing charge transporting segments such as electrically active polymeric arylamine compounds. Typical polymeric arylamine compounds include, for example, the polymeric reaction product formed by reacting N,N'-diphenyl N,N' bis(3-hydroxyphenyl)-(1,1'-biphenyl)-4,4' diamine with diethylene glycol bis-chloroformate, a copolymer formed by reacting N,N'-bis(3-(2-hydroxyethyl)phenyl aniline and 4,4'-isopropylidene diphenol, ("bisphenol A"), with diethylene glycol bischloroformate, a copolymer formed by reacting N,N'-diphenyl-N,N'-bis[3-(2-hydroxyethyl)]phenyl-1,1'-biphenyl-4,4'diamine and bisphenol A with diethylene glycol bischloroformate, or a copolymer formed by reacting N,N'-bis,3-hydroxphenyl(1,1'-biphenyl) 4,4' diamine and bisphenol A with diethylene glycol bischloroformate. Preferred polymeric arylamine compounds have a molecular weight from about 5000 to about 1,000,000, more preferably, from about 50,000 to about 500,000. These and other transporting polymers are described in U.S. Pat. No. 4,801,517; U.S. Pat. No. 4,806,443; U.S. Pat. No. 4,806,444; U.S. Pat. No. 4,818,650; U.S. Pat. No. 4,871,634; U.S. Pat. No. 4,935,487; U.S. Pat. No. 4,956,440 and U.S. Pat. No. 5,028,687, the entire disclosures of these patents being incorporated herein by reference. These polymeric arylamine compounds are capable of supporting the injection of photogenerated holes from the charge generating layer and allowing the transport of these holes through the charge transport layer to selectively discharge the charge on the outer exposed imaging surface.

In U.S. Pat. No. 5,069,993 a diblock dimethylpolysiloxane-carbonate polymer is employed in a charge transport layer or anti-curl backing layer, the entire disclosure of this patent being incorporated herein by reference. The siloxane of U.S. Pat. No. 5,069,993 is a solid, does not have an extended organic side chain, and needs a relatively large amount of additive, e.g., 2.5 percent of additive, to achieve the benefits sought. Moreover, no charge transporting polymer is utilized in the imaging member of U.S. Pat. No. 5,069,993.

An optional overcoat layer may also be applied over the charge transport layer to protect the charge transport layer from abrasion. The overcoat layer may comprise any suitable film forming polymer such as the film forming polymers employed in the charge transporting layer or charge generating layer. Similarly, any suitable solvent may be utilized to apply the overcoating layer using conventional coating techniques. Preferably, the overcoating layer has a thickness between about 3 micrometers and about 7 micrometers.

Other layers such as a conventional ground strip layer comprising, for example, conductive particles dispersed in a film forming binder may be applied to one edge of the photoreceptor in contact with the conductive layer, hole blocking layer, adhesive layer or charge generating layer. The ground strip may comprise any suitable film forming polymer binder and electrically conductive particles. Typical ground strip materials include those enumerated in U.S. Pat. No. 4,664,995. The ground strip layer may have a thickness from about 7 micrometers to about 42 micrometers, and preferably from about 14 micrometers to about 23 micrometers.

In some flexible electrophotographic imaging members, an anti-curl layer may be applied to the side opposite the side bearing the electrically active coating layers in order to maintain imaging member flatness as well as enhance abrasion resistance.

The outermost imaging layer of the electrostatographic imaging member of this invention always has an exposed imaging surface and a continuous matrix comprising a film forming binder and a liquid surface energy lowering siloxane. This outermost imaging layer may be an overcoating layer, a charge transport layer or a charge generating layer. If the outermost layer is a charge transport layer, single photoconductive imaging layer or charge generating layer, the outermost layer may comprise any suitable electrically inactive film forming binder, an organic small molecule charge transporting compound and the liquid surface energy lowering siloxane, or any suitable electrically active film forming binder, an optional organic small molecule charge transporting compound, and the liquid surface energy lowering siloxane. The film forming binder should be miscible with the liquid siloxane and soluble in the coating solvent. The single photoconductive imaging layer or charge generating layer will also contain photoconductive particles. If the outermost layer is an overcoating layer, the outermost layer may comprise an electrically inactive film forming binder, an optional aromatic charge transporting organic compound, and the liquid surface energy lowering siloxane.

The liquid surface energy lowering siloxane may be represented by the formula:

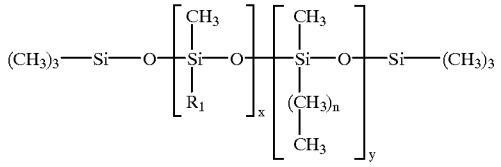

wherein x and y are independently selected integers between about 5 and about 500, n is a number between 0 and 10, and $R_1$ is selected from the group consisting of:

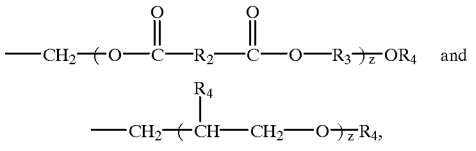

wherein z is number between about 1 and about 30, $R_2$ and $R_3$ are independently selected from alkylene groups containing from 1 to 10 carbon atoms, $R_4$ is a hydrogen atom or an alkyl group containing 1 to 3 carbon atoms.

Polysiloxane surface energy lowering liquids represented by the above formulae are commercially available and include, for example, Byk 310®, available from Byk Chemie USA. This material is a chemically polyester modified dimethylpolysiloxane oligomer in which some of the methyl pendant groups are extended and altered to give long organic side chains that increase the compatibility of the polysiloxane molecule with the film forming polycarbonate of the charge transport layer or single photoconductive imaging layer. Still another polyester modified dimethylpolysiloxane is Byk 370®, also available from Byk Chemie USA.

Still other effective liquid polysiloxane surface energy lowering liquids represented by the above formulae include polyether modified polysiloxanes. These polyether modified polysiloxanes are also commercially available as polyether modified dimethylpolysiloxanes, for example, Byk 300®, Byk 301®, Byk 306®, Byk 341® and Byk 344® as well as polyether modified methylalkylpolysiloxanes, for example, Byk 320®, Byk 325®, and Byk 077® from Byk Chemie USA.

Preferably, the dried outermost layer having the imaging surface, whether a charge transport layer, single photoconductive imaging layer, charge generating layer or overcoating layer, preferably contains between about 0.005 percent and about 2 percent by weight of the polysiloxane, based on the total weight of the layer after drying to yield beneficial surface energy reduction. Compared to a typical conventional imaging member surface having a surface energy of about 43 dynes/cm, the dried outermost layer of imaging member of this invention containing the liquid polysiloxane of the preferred range has a surface energy of between about 38 dynes/cm and 22 dynes/cm in order to satisfy the beneficial objects of this invention.

Preferably, the dried charge transport layer of this invention contains between about 0.005 percent and about 2 percent by weight of liquid polysiloxane, based on the total dried weight of the charge transport layer. When added into the imaging layer at the specified low concentrations, the polysiloxane is dissolved or dispersed on a molecular scale, to achieve exposure of the low surface energy siloxane backbone at the outer surface of the coating layer, and does not affect the optical transmittance of the charge transport layer because the polysiloxane has an extended organic side chain which is compatible with charge transport layer material matrix, particularly a matrix comprising polycarbonate binders. Also, the presence of the liquid polysiloxane does not adversely impact photo-electrical performance nor degrade mechanical properties of the resulting electrophotographic imaging member.

For preparation of the coating solution, any suitable solvent for the siloxane, film forming binder, and any charge transporting component present in the outermost layer may be employed. Typical combinations include, for example, a siloxane, a film forming polymer binder, and charge transporting small molecule (monomeric) organic compound combination; siloxane and charge transporting organic polymer combination; and a siloxane, charge transporting organic polymer and combination. Typical solvents include, for example, methylene chloride, toluene, tetrahydrofuran, cyclohexane, hexane, heptane, chlorobenzene, and the like. Generally, the weight proportions of soluble solids to solvent is between about 5:95 and about 25:75.

The outermost exposed layer such as the overcoat, charge transport layer, or generation layer of this invention may optionally contain organic and/or inorganic particles dispersed therein. The particles are easily dispersed by conventional coating solution mixing techniques and result in no particle agglomerations in the outermost exposed layer. The particles further have inherent wear resisting characteristics and are capable of providing lubricity to ease the sliding mechanical interaction at the outermost exposed layer surface. The particles have refractive indices closely matched with that of the binder polymer of the outermost exposed layer so that particle dispersions in the layer material matrix do not affect the optical transmittance of the layer. Also, the presence of the particles produces no adverse impact on the electrical performance of the resulting photoconductive imaging member. An inorganic particle of particular interest is microcrystalline silica, a naturally occurring irregularly shaped quartz particle available, for example, from Malvern Minerals Company. Microcrystalline silica also exists in two other forms (christobalite and tridymite). The microcrystalline silica has a Moh Hardness Number of about 7 with excellent inherent abrasion resistance. Compared to the Moh Hardness Number of 5.5 for a synthetic amorphous silica counterpart, the microcrystalline silica is a mechanically superior filler for wear resistance enhancement. Other particulates of silica derivatives, such as micrometer size ground glass and micrometer size synthetic glass spheres (available from Cataphote Division, Ferro Corporation), may also be used. To improve particle-polymer interaction, the microcrystalline silica particles may be surface treated with bifunctional silane coupling agents. Preferred silane coupling agents available for silica particle treatment include chloropropyl triethoxy silane, having a molecular formula $Cl(CH_2)_3Si(OC_2H_5)_3$, and azido silane, having a molecular formula:

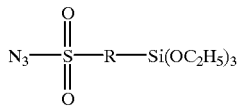

These silanes are employed in hydrolyzed forms because the OH groups of the hydrolyzed silanes readily react with the silanol functional groups of the microcrystalline silica surfaces and condense to form siloxane bonds at elevated temperature. The condensation reaction between the OH and silanol groups will position the siloxane at the surfaces of the silica particles and orient the organo-functional group outward to interact with the polycarbonate film forming polymer binder in the anti-curl layer matrix. The hydrolyzed silane solution which may be utilized to treat the microcrystalline silica may be prepared by hydrolyzing the alkoxy groups of a silane in an excess amount of water to form a dilute aqueous solution having about 0.1 weight percent to about 5.0 weight percent silane. A solution pH between about 9 and 13 is preferred. The control of the pH of the hydrolyzed silane solution may be achieved by acetic acid or hydrogen iodide addition. The silane microcrystalline silica surface treatment may be effected by washing the silica particles in the dilute hydrolyzed silane solution for about 1 minute to about 30 minutes. The resulting silica particles are filtered with a filter paper and dried at 135° C. in an oven for about 30 minutes to complete the silane surface treatment process. Alternatively, hydrolysis of the silane and surface treatment may also be effected directly at the surfaces of the microcrystalline silica particles as described, for example, in Example 2 of U.S. Pat. No. 3,915,735.

Other micrometer size inorganic particles having high hardness and exceptional wear resisting properties include, for example, diamond (Moh hardness 10), corundum (Moh hardness 9) and topaz (Moh hardness 8).

The organic particles selected for dispersion in the anti-curl layer include, for example, ALGOFLON, POLYMIST, and ACUMIST. ALGOFLON, available from Ausimont U.S.A., Inc., comprises irregular shaped polytetrafluoroethylene (PTFE) particles. This material has inherent slipping characteristics. When dispersed in the charge transport layer, ALGOFLON lowers the surface contact friction of the anti-curl layer and eases the sliding mechanical interaction of the surface to minimize wear. POLYMIST, available from Ausimont U.S.A., Inc., comprises irregular shaped PTFE particles which are similar to ALGOFLON, with the exception that the particles are gamma ray irradiated to increase their hardness. As a result of gamma ray irradiation, the POLYMIST exhibits improved wear properties when incorporated into the outermost exposed layer. ACUMIST, available from Allied-Signal, Inc., comprises irregular shaped micronized waxy polyethylene particles having the molecular formula $CH_3(CH_2)_mCH_3$, in which m is a number of repeating units for a molecular weight between about 2000 and about 3500. The oxidized form of ACUMIST is a polyethylene homopolymer having a molecular formula $CH_3(CH_2)_mCH_2COOH$.

The above inorganic and organic particles, as supplied by the manufacturers, have particle size distributions from about 0.1 micrometer to about 9 micrometers in diameter. For outermost exposed layer dispersions, these particles are classified to give a preferred average particle size between about 0.1 micrometer and about 4.5 micrometers, with the largest particle having a size of about 4.5 micrometers or less.

The optional particulate material can be present in the outermost exposed layer of the imaging member in a range up to about 10 percent by weight, preferably less than 7 percent by weight, based on the total weight of solids in the dried outermost exposed layer. Optimum results are obtained when the coating mixture contains particulate material in a concentration of between about 0.5 percent by weight and about 5 percent by weight based on the total weight of solids in the dried outermost exposed layer. When the optional particles are added to the outermost layer coating solution to form a coating dispersion, the solvent selected to apply the coating dispersion should not dissolve the particles.

Organic and inorganic particle dispersions are described in U.S. Pat. No. 5,096,795, the entire disclosure of this patent being incorporated herein by reference.

The outermost exposed layer coating solution of this invention can be applied by any suitable photoreceptor fabricating technique. Typical coating techniques include solvent coating, extrusion coating, spray coating, dip coating, lamination, solution spin coating and the like. The deposited coatings may be dried by any suitable drying technique, including, for example, such oven drying, forced air drying, circulating air oven drying, radiant heat drying, and the like.

The electrophotographic imaging member of the present invention may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface. Although the bulk of discussion has focused on a charge transport layer containing the siloxane, this invention is intended to include surface energy reduction of the exposed imaging surface of the outermost layer of the imaging member which may be a charge transport layer, a charge generation layer, a single photoconductive layer or an overcoating layer.

The electroreceptor embodiment of this invention may be utilized in any suitable electrographic imaging system in which a shaped electrostatic image is directly formed on a dielectric imaging layer by any suitable means such as styli, shaped electrodes, ion streams, and the like.

The charge transport layer of this invention, obtained by incorporation of surface energy modifier, exhibits surface energy lowering, eliminates comet spots caused by debris and toner particles fusing to its surface, enhances the cleaning blade's efficiency, improves the wear resistance, as well as reducing surface contact friction between the charge transport layer and the anti-curl layer in electrophotographic imaging member webs that are rolled up for storage prior to cutting and seam welding into belts. The charge transport layer of this invention maintains the optical clarity requirement of the charge transport layer in the embodiment where light must be transmitted through the layer during electrophotographic imaging processes to ensure copy image quality.

The invention will further be illustrated in the following non-limiting examples, it being understood that these examples are intended to be illustrative only and that the invention is not intended to be limited to the materials, conditions, process parameters and the like recited herein. All proportions are by weight unless otherwise indicated.

CONTROL EXAMPLE I

An electrophotographic imaging member was prepared by providing a 0.02 micrometer thick titanium layer coated on a polyester substrate (PET) (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with a ½ mil gap Bird applicator to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

The adhesive interface layer was thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 milliliters of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine were dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 10 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in a forced air oven to form a dry photogenerating layer having a thickness of 2.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4-4'-diamine and Makrolon 5705, a polycarbonate resin having a molecular weight of from about 50,000 to 100,000 commercially available from Farbenfabriken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

This ground strip layer, after drying at 135° C. in a forced air oven for 5 minutes, had a dried thickness of about 14 micrometers. This ground strip is electrically grounded, by conventional means such as a carbon brush contact device during a conventional xerographic imaging process.

An anti-curl coating (ACL) was prepared by combining 8.82 grams of polycarbonate resin of 4,4'-isopropylidene diphenol (Makrolon 5705, having a molecular weight of about 120,000 and available from Bayer AG), 0.08 gram of copolyester resin (Vitel PE-100, available from Goodyear Tire and Rubber Company) and 90.1 grams of methylene chloride in a glass container to form a coating solution containing 9 percent solids. The container was covered tightly and placed on a roll mill for about 24 hours until the polycarbonate and polyester were dissolved in the methylene chloride to form the anti-curl coating solution. The anti-curl coating solution was then applied to the rear surface (side opposite the photogenerator layer and charge transport layer) of the imaging member with a 3 mil gap Bird applicator and dried at 135° C. for about 5 minutes in a forced air oven to produce a dried film thickness of about 13.5 micrometers and containing approximately 1 weight percent Vital PE-100 adhesion promoter, based on the total weight of the dried anti-curl layer.

EXAMPLE II

An electrophotographic imaging member was prepared by following the exact procedures and using the same materials as described in the Control Example I, except that the charge transport layer was modified by the incorporation of a polyester modified polysiloxane (Byk 310®, available from Byk-Chemie USA). The polysiloxane, as described hereinabove, had a molecular structure encompassing a inorganic silicon-oxygen backbone and a long polyester or polyether side chain which was compatible with the polycarbonate material matrix of the charge transport layer. This polysiloxane slip agent was a non volatile liquid which readily dissolved in the charge transport layer coating solution. After solution coating and drying at 135° C. for 5 minutes, the polysiloxane slip agent bloomed to the exposed imaging surface of the charge transport layer and exposed the siloxane backbone to modify the surface energy of the charge transport layer while anchoring itself securely through extending the long organic side chains into the material matrix of the resulting dry charge transport layer. The fabricated electrophotographic imaging member had an optically clear charge transport layer which contained 0.10 percent by weight polysiloxane slip agent, based on the total weight of the dry charge transport layer.

EXAMPLE III

An electrophotographic imaging member was prepared by following the exact procedures and using the same materials as described in the Control Example I, except that the polysiloxane content in the resulting dry charge transport layer of the fabricated electrophotographic imaging member was 0.025 percent by weight, based on the total weight of the dry charge transport layer.

EXAMPLE IV

An electrophotographic imaging member was prepared by following the exact procedures and using the same materials as described in the Control Example 1, except that the polysiloxane slip agent content in the dry charge transport layer was 0.05 percent by weight, based on the total weight of the dry charge transport layer.

EXAMPLE V

The electrophotographic imaging members of Control Example I as well as Examples II through IV were evaluated for surface contact friction between the charge transport layer and the anti-curl layer to assess the surface frictional interaction between these two contacting layers in a 6,000 foot roll-up imaging member webstock. The charge transport layer of each of these imaging members was further investigated for adhesion, wear resistance, surface energy reduction, and relative surface abhesiveness. The impact of the presence of polysiloxane in the charge transport layer material matrix on the ultrasonic seaming process employed for imaging member belts fabrication was also evaluated by measuring the seam rupture strength of each imaging member and compared to the result obtained for the seam control of the imaging member of Control Example.

The measurement of coefficient of surface contact friction between the charge transport layer and the anti-curl layer was carried out by fastening a sample of an imaging member of each Example to a flat platform surface with the charge transport layer facing upwardly and another sample of an imaging member from the same Example secured to the flat surface of the bottom of a horizontally sliding plate weighing 200 grams, with the anti-curl layer of the sample facing outwardly away from the sliding plate, to expose the ant-curl layer. The sliding plate was then dragged, with the anti-curl back coating facing downwardly, in a straight line over the platform so that the horizontal anti-curl layer surface moved while in frictional engagement with the horizontal charge transport layer surface. The sliding plate was moved by a cable having one end attached to the plate and having the other end threaded around a freely rotating pulley and fastened to the jaw of an Instron Tensile Tester. The pulley was positioned so that the segment of the cable between the weight and the pulley was parallel to the flat horizontal platform surface. The cable was pulled vertically upwardly from the pulley by the jaw of the Instron Tensile Tester and the load required to slide the sliding plate, with the anti-curl layer surface against the charge transport layer surface, was monitored using a chart recorder. The coefficient of friction between the charge transport layer (CTL) and the anti-curl layer (ACL) was then calculated by dividing the sliding force or load recorded by the chart recorder by 200 grams.

The coefficient of friction measurement was again repeated as above, but with the exception that the sliding plate was anchored with an elastomeric polyurethane cleaning blade to simulate cleaning blade/charge transport layer cleaning action during electrophotographic imaging and cleaning processes. The value of coefficient of surface contacting friction between each charge transport layer and the polyurethane cleaning blade was also calculated by dividing the sliding force required to pull the sliding plate by 200 grams.

The 180° peel strength to separate the charge transport layer from the charge generating layer was assessed by cutting a minimum of three 0.5 inch (1.2 cm.)×6 inches (15.24 cm.) imaging member samples from each of Control Example I and Examples II to IV. For each sample, the charge transport layer was partially stripped from the test sample with the aid of a razor blade and then hand peeled to about 3.5 inches from one end to expose the charge generating layer inside the sample. This stripped sample was then secured to a 1 inch (2.54 cm.)×6 inches (15.24 cm.) and 0.05 inch (0.254 cm.) thick aluminum backing plate (having the anti-curl layer facing the backing plate) with the aid of two sided adhesive tape. The end of the resulting assembly, opposite the end from which the charge transport layer was not stripped, was inserted into the upper jaw of an Instron Tensile Tester. The free end of the partially peeled charge transport layer was inserted into the lower jaw of the Instron Tensile Tester. The jaws were then activated at a one inch/mm crosshead speed, a two inch chart speed and a load range of 200 grams, to peel the sample at least two inches at an angle of 1800. The load was calculated to derive the peel strength of the sample. The peel strength was determined to be the force required for stripping the charge transport layer divided by the width (1.27 cm.) of the test sample.

The electrophotographic imaging members of Control Example I and Examples II through IV were also each cut to a size of 1 inch (2.54 cm.) by 12 inches (30.48 cm.) and each tested for resistance to wear of the anti-curl layers. Testing was effected by means of a dynamic mechanical cycling device in which glass tubes were skidded across the surface of the charge transport layer on each imaging member. More specifically, one end of the test sample was clamped to a stationary post and the sample was looped upwardly over three equally spaced horizontal glass tubes and then downwardly over a stationary guide tube through a generally inverted MU shaped path with the free end of the sample secured to a weight which provided one pound per inch width tension on the sample. The outer surface of the imaging member bearing the charge transport layer faced downwardly so that it would periodically be brought into sliding mechanical contact with the surface of the glass tubes to cause charge transport layer wear. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the charge transport layer was in sliding mechanical contact with a single stationary support tube during the testing. The rotation of the spinning disk was adjusted to provide the equivalent of 11.3 inches (28.7 cm.) per second tangential speed. The extent of charge transport layer wear was measured using a permascope at the end of a 66,000 wear cycles test.

Determination of the surface energy of the charge transport layer was carried out through measurements of contact angle of water over the charge transport layer and using the geometric-mean method of surface energy calculation. An average of four contact angle measurements were made to arrive at the calculated surface energy value for each imaging member. The surface abhesiveness of each charge transport layer of the imaging members was measured by applying a 0.75 inch width Scotch Brand Magic Tape # 810, available from 3M Corporation, onto the charge transport layer surface with rolling the adhesive tape over with a 5 lb. weight to ensure uniform pressure and then using the 180° tape peel test procedures described above.

For mechanical seam integrity tests, each imaging member described above was cut into 2 sheets, the opposite ends of each sheet being brought together by overlapping one millimeter of the ends of each of the 2 sheets, followed by joining the ends with an ultrasonic welding process, at 40 kHz frequency, to form a welded seam. The seamed imaging members were each cut into a 0.5 inch or 1.27 cm width test sample, with the seam at the middle. Each sample was tension pulled using the Instron machine, with a 2 inch gauge length and 0.2 inch per minute crosshead speed, until the seam ruptured. The force required to rupture the seam divided by the width gives the seam break strength.

The results obtained for coefficient of surface contact friction measurements for each charge transport layer (CTL) against the anti-curl layer (ACL) as well as against the cleaning blade; CTL and charge generation layer (CGL)

adhesion strength; CTL wear resistance; 1800 tape peel strength; imaging member seam rupture strength; and CTL surface energy are listed in the Table below:

TABLE

| Example | Slip Agent in ACL | Coefficient of Friction CTL & ACL | Coefficient of Friction CTL & Blade | CTL Thickness Wear Off (micro-meters) | Seam Break Strength (kg/cm) | CTL/CGL Peel Strength (gms/cm) | 180° Tape Peel Strength (gms/cm) | CTL Surface Energy (dynes/cm |
|---|---|---|---|---|---|---|---|---|
| I (Control) | None | 3.17 | 3.08 | 2.5 | 10.92 | 98.7 | 450 | 43.0 |
| II | 0.010% | 2.56 | 1.76 | 1.5 | 10.23 | 98.3 | 362 | 30.1 |
| III | 0.025% | 2.32 | 1.25 | 1.5 | 10.87 | 98.7 | 344 | 29.8 |
| IV | 0.050% | 1.76 | 1.16 | 1.0 | 10.86 | 97.9 | 290 | 28.8 |

The data listed in the table above shows that the coefficient of surface contact friction between the charge transport layer and the anti-curl layer was substantially reduced from 3.17 to a lower value of between 2.56 and 1.76 when the charge transport layer of the prior art electrophotographic imaging member of Control Example I was modified to yield the charge transport layers of this invention. Furthermore, the effective coefficient of surface contact friction reduction between the charge transport layer of this invention and the anti-curl layer should resolve the puckering, dimples, delamination of coating layers, and deformation of inner layers problems seen in a conventional 6,000 feet roll of electrophotographic imaging member webstock. The presence of the liquid polysiloxane in the charge transport layer also provided an effective decrease in frictional interaction during contacting relative movement between the charge transport layer and cleaning blade to suppress charge transport layer wear as well as increasing cleaning efficiency of the blade. Since the presence of surface energy lowering polysiloxane in the charge transport layer eases mechanical sliding action, the wear resistance of the charge transport layer was improved. In addition, the charge transport layers of this invention containing the liquid polysiloxane did not interfere with the imaging member ultrasonic seam welding process to affect the final seam strength nor produce any deleterious effect on the adhesion bond strength of the charge transport layer to the charge generating layer. An additional benefit observed was that the electrophotographic imaging members having the charge transport layer of this invention described in Examples II to IV, like the imaging member of Control Example I, did not cause surface scratching nor exacerbate wear of the ultrasonic horn during seam welding to fabricate the belt.

The results obtained for surface abhesiveness and surface energy determinations, carried out, respectively, by 1800 tape peel test and contact angle measurement of water droplet over the charge transport layer, showed very promising surface energy modification outcomes. These results were direct indications that the presence of liquid polysiloxane in the charge transport layer achieves surface energy reduction for the charge transport layer by increasing the surface abhesiveness of the layer to enhance toner image paper transfer efficiency and prevents residue toner surface fusing which form undesirable comets. Low surface energy charge transport layer also ease dirt, toner residue, and debris removal by the cleaning blade during imaging belt machine image cycling. In other words, the tape peel test results complimented the surface energy measurement results to indicate the transformation of a charge transport layer surface from an adhesive one to an abhesive one was effected with the addition of just a small amount of liquid polysiloxane.

It is very important to point out that the presence of liquid polysiloxane in the charge transport layer, at all tested levels, to effect surface energy reduction did not appear to alter the crucial photo-electrical integrity of the resulting electrophotographic imaging members.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising a supporting substrate having an electrically conductive outer surface and at least one layer having an exposed imaging surface, the layer comprising a continuous matrix comprising a film forming polymer and a surface energy lowering liquid polysiloxane represented by the formula:

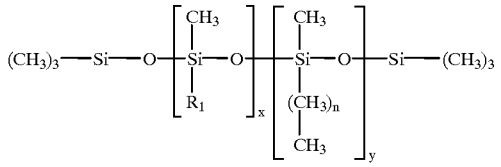

wherein x and y are independently selected integers between about 5 and about 500, n is a number between 0 and 10, and $R_1$ is selected from the group consisting of:

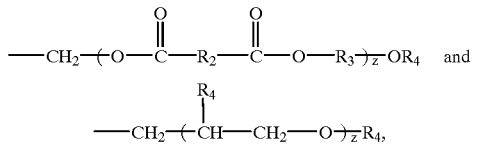

wherein z is number between about 1 and about 30, $R_2$ and $R_3$ are independently selected from alkylene groups containing from 1 to 10 carbon atoms, and $R_4$ is a hydrogen atom or an alkyl group containing 1 to 3 carbon atoms.

2. An electrostatographic imaging member according to claim 1 wherein the at least one layer having an exposed imaging surface is a charge transport layer overlying a charge generating layer.

3. An electrostatographic imaging member according to claim 1 wherein the at least one layer having an exposed imaging surface is a charge generating layer overlying a charge transport layer.

4. An electrostatographic imaging member according to claim 1 wherein the at least one layer having an exposed imaging surface is an overcoating layer overlying at least one photoconductive imaging layer.

5. An electrostatographic imaging member according to claim 1 wherein the film forming polymer in the continuous matrix is a polycarbonate.

6. An electrostatographic imaging member according to claim 1 wherein the at least one layer having an exposed imaging surface comprises a charge transport layer which also comprises particles selected from the group consisting of organic particles, inorganic particles and mixtures thereof.

7. An electrostatographic imaging member according to claim 6 wherein the particles have an average particle size of between about 0.1 micrometer to about 4.5 micrometers.

8. An electrostatographic imaging member according to claim 6 wherein the particles are present in the charge transport layer in an amount up to about 10 percent by weight, based on the total weight of solids in charge transport layer after drying.

9. An electrostatographic imaging member according to claim 1 wherein the at least one layer having an exposed imaging surface comprises the film forming polymer and between about 0.005 and about 2 percent by weight of the polysiloxane, based on the total weight of the layer after drying.

10. An electrostatographic imaging member according to claim 1 wherein the at least one layer having an exposed imaging surface comprises a charge transport layer comprising an electrically insulating film forming polymer binder, a small molecule charge transporting organic compound, and between about 0.005 and about 2 percent by weight of the polysiloxane, based on the total weight of the charge transport layer after drying.

11. An electrostatographic imaging member according to claim 10 wherein the charge transport layer comprises a continuous matrix comprising a charge transporting film forming polymer.

12. An electrostatographic imaging member according to claim 1 wherein the exposed imaging surface has a surface energy of between 38 dynes/cm and about 22 dynes/cm.

13. An electrostatographic imaging member according to claim 1 wherein the outermost exposed imaging surface comprises a dielectric imaging layer.

* * * * *